United States Patent [19]

Batts et al.

[11] Patent Number: 4,746,039

[45] Date of Patent: May 24, 1988

[54] SLIDING CLAMP HANGER

[75] Inventors: John H. Batts, East Grand Rapids; Howard DeMaagd, Wyoming; Judd Garrison, Grand Rapids, all of Mich.

[73] Assignee: Batts, Inc., Zeeland, Mich.

[21] Appl. No.: 941,097

[22] Filed: Dec. 12, 1986

[51] Int. Cl.[4] ..... A41D 27/22

[52] U.S. Cl. ..... 223/96; 211/119; D6/326

[58] Field of Search ..... 223/93, 96, 90, 91; D6/326; 211/119; 24/461, 462, 522, 460

[56] References Cited

U.S. PATENT DOCUMENTS

| | | | |
|---|---|---|---|
| 818,748 | 4/1906 | Cragin | D6/326 |
| 1,278,785 | 9/1918 | Tainter | 24/461 X |
| 3,352,430 | 11/1967 | McAtee | 211/119 |
| 3,950,829 | 4/1976 | Cohen | 223/96 X |
| 4,261,121 | 4/1981 | Coon | 223/96 X |

FOREIGN PATENT DOCUMENTS

| | | | |
|---|---|---|---|
| 162479 | 5/1921 | United Kingdom | 223/96 |

*Primary Examiner*—Andrew M. Falik

*Attorney, Agent, or Firm*—Price, Heneveld, Cooper, DeWitt & Litton

[57] ABSTRACT

An article hanger, particularly useful for clothes such as skirts and slacks has an elongated body. Except in the general area of the hook by which the hanger is suspended, the body consists of a pair of elongate arms. A pair of article clamps are supported on the body. For this purpose the arms pass through the clamps and an anchor device on the clamps embraces and grips the said arms preclude pivoting of the clamps and with enough force to prevent sliding movement of the clamps under normal conditions when supporting a garment but permitting an operator to intentionally reposition the clamps lengthwise of the body.

16 Claims, 2 Drawing Sheets

SLIDING CLAMP HANGER

FIELD OF THE INVENTION

This invention relates to hangers for articles and particularly to hangers designed for both transport and display of garments or similar products. The hanger is of the article clamping type and is designed to be molded of plastic.

BACKGROUND OF THE INVENTION

Since clothing and other articles come in various sizes, it has heretofore been customary practice to mold hangers in a range of sizes, each size being adapted to effectively support garments of a limited size range. To effectively suspend a garment by means of clamps, particularly for display, it is necessary that the spacing of the clamps permit them to grip the garment reasonably close to each end. If clamps are so close together that they are significantly spaced from the ends of the garment, the ends will fold down. This is not acceptable for either transport or display. On the other hand, if the clamps are too far apart only the very ends of the garment can be gripped and this is also unacceptable. The need for a range of sizes has heretofore necessitated the design and making of a number of molds, each mold being devoted to production of hangers of one particular size. Thus, the hanger manufacturer has to have a substantial investment in tooling. Further, this arrangement makes it necessary to maintain an inventory of each hanger size, in order to be capable of satisfying various customer needs.

The purpose of this invention is to obviate the need for the manufacture of a range of hangers each of a particular size by making it possible to satisfy all of the needs with a hanger of a single size, so constructed that the spacing between the clamps which actually grip the garment can be adjusted in accordance with the requirements of the garment. Even if the size range is too great for a single size of hanger, the invention reduces the number of sizes to a very few, each capable of handling a significant range of clothing sizes. This permits a single hanger design to satisfy a wide range of customer requirements. Further, it greatly increases convenience for the customer since customer needs with respect to hanger requirements change from time to time and can be immediately satisfied. In the past, customers had to maintain a supply of hangers of various sizes to satisfy these needs. This invention makes it possible normally to satisfy all of the customer's needs for article clamping hangers from a stock of hangers all of the same size and type merely by readjusting the hanger to the particular requirements of the customer at that particular time. This is both a convenience and a substantial reduction in hanger inventory investment as well as manufacturing and retail facility logistics.

However, making an article clamping hanger so that it is readily adjustable in width without also making it both costly and clumsy to use, involves the solution of a number of structural and functional problems. Among other things, it was necessary to develop a simple means permitting article clamp position adjustment while providing position stability while in use to prevent the clamps from being pulled toward each other as a result of the weight of the article suspended between the clamps. This is necessary, particularly in the case of garments, because it is desirable to apply some degree of tension to the garment between the clamps so that it will have a neat appearance. This is particularly true where the hanger is utilized for retail display. It was also necessary to prevent the clamps from pivoting about their support so that the garment would be properly draped and displayed and also to facilitate securing and removing the garment from the hanger. These problems had to be solved by relatively simple means both to keep the cost of the hanger within an acceptable range and also to prevent the use of the hanger from becoming complex and difficult and, thus, user antagonistic.

SUMMARY OF THE INVENTION

The invention includes a body, portions of which may be of molded plastic, and the remainder may be a pair of metal rods. The rods are vertically spaced and preferably aligned in the same vertical plane. The rods provide a track on which garment or article gripping clamps are mounted. The means by which the clamps are secured to the rod permit the clamps to be forcibly moved lengthwise of the rod when necessary to adjust the spacing of the clamps. However, sufficient frictional engagement is provided between the clamps and the rods to resist movement of the clamps lengthwise of the rods due to loads imposed on the clamps by the article or clothing secured by the clamps. The particular means on the clamp by which the clamp is secured to the rod can have any one of a number of different constructions. The design of this securement means may be such that the clamps must be mounted on the rods before the rods are secured to the molded plastic body portion from which they are supported. In another construction, the clamps are so designed that they may be snapped onto the rods after the rods have been secured to the supporting block which block also provides a means of attachment of the hook or other device by which the hanger can be suspended.

The invention has the advantage, in the manufacture of a garment clamping hanger, of separating the manufacture of the hanger body from that of the clamps. This simplifies the tool and manufacturing procedures and, thus, the final cost of the hangers. It also makes it possible to introduce structural and ornamental changes at a much reduced cost.

DESCRIPTION OF THE PREFERRED EMBODIMENTS

Figure 1:
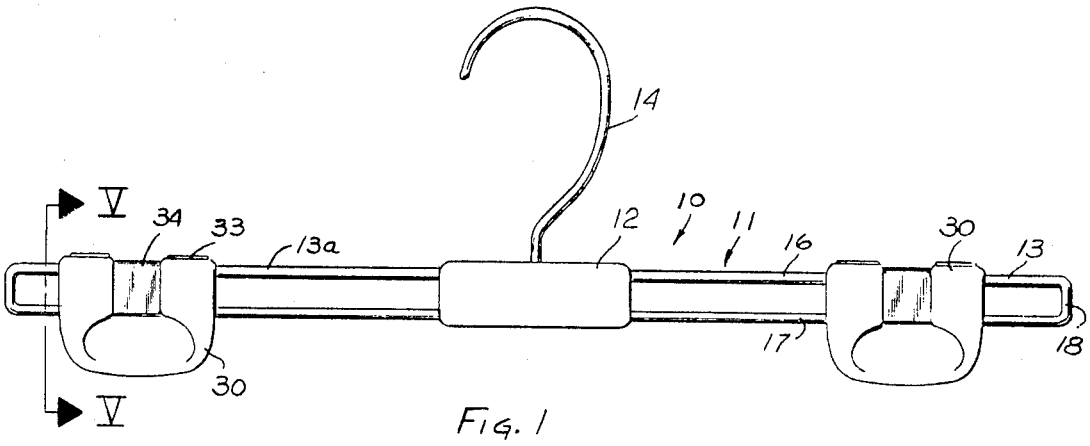
FIG. 1 is a front elevation view of a hanger incorporating this invention.
Figure 12:
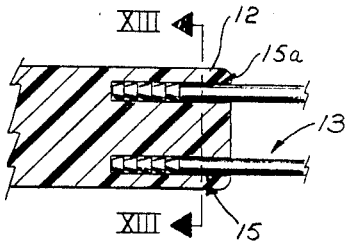
FIG. 12 is a fragmentary sectional view of a modified construction for the central block and rods for the hanger.
Figure 13:
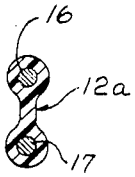
FIG. 13 is a sectional view taken along the plane XIII—XIII of FIG. 12.

Referring to FIG. 1, the numeral 10 indicates a hanger having a body 11, including a central body portion or block 12 and a pair of arms 13 and 13*a*. A means of support, in this case, a hook 14 is secured to the central block 12 and is located midway between the ends of the body 11. It will be recognized that, while a wire hook is illustrated, that the hook could be molded as an integral part of the block 12 without in any way affecting the about to be described invention. In the preferred construction, the block 12 is centered midway between the ends of the body 11. The block, in the preferred construction, on each end has a pair of vertically spaced openings 15 and 15*a* which receive the ends of the U-shaped arms 13 and 13*a* (FIG. 12). Preferably, the ends of the arms are barbed whereby, once inserted into the molded plastic of the block, will be fixed to the block and cannot be readily removed. The block can be molded of any suitable plastic such as polypropolyene, styrene K-Resin, trademark of Phillips Petroleum, for a styrene butadiene resin. Also useable is ABS, an acrylonitrile butadiene styrene resin.

The arms 13 are preferably formed into a U-shape from steel wire or rod providing an upper rail 16 and a lower rail 17. A suitable material would be steel rod or wire. These rails are straight, parallel and joined by a vertically extending end portion 18 for resistance to vertical deflection. When the arms 13 have been secured to the block 12 they are rigid and the body of the hanger is symmetrical about the hook 14.

Figure 5:
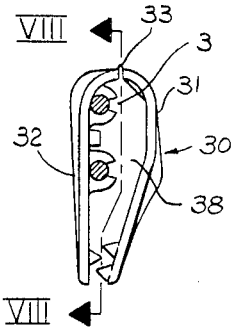
FIG. 5 is a sectional elevation view taken along the plane V—V of FIG. 1.
Figure 3:
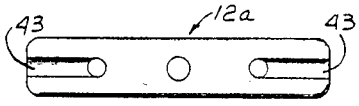
FIG. 3 is a plan view of the central block for the hanger illustrated in FIG. 1.
Figure 6:
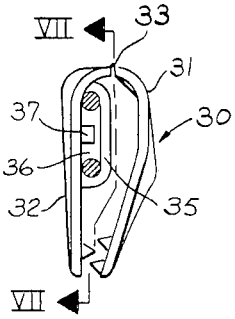
FIG. 6 is a view similar to FIG. 5 but showing a different construction.
Figure 7:
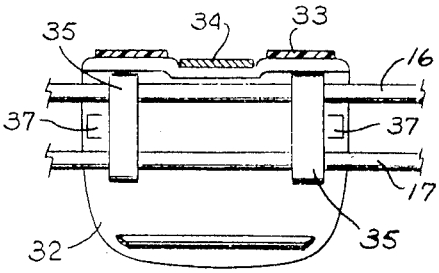
FIG. 7 is a sectional elevation view taken along the plane VII—VII of FIG. 6.

Mounted on each of the arms 13 is a clamp 30. The clamp 30 basically consists of a front leg 31 and a rear leg 32, pivotally joined at their upper ends by a thin web forming a hinge 33 (FIGS. 5, 6 and 7). The clamps 30 are molded as a one-piece, unitized article from polypropolyene, a material which will provide a flexible, fatigue resistant hinge between the jaws. The center of the clamp 30 has a vertical, recessed track midway between its ends which seats a vertically slidable, U-shaped spring 34. When the spring is in the up or raised position, the front leg 31 can be freely pivoted away from the rear leg, opening the clamp. When the spring is depressed into the position illustrated in FIG. 1, the spring resiliently holds the front leg 31 in clamping position, as illustrated in FIG. 6. The spring is such that it can be readily shifted to release position by the operator pushing it upwardly with his thumb and, in a similar manner, can be pushed down to close the clamp. Because the spring 34 is resilient, the particular degree to which the front leg or jaw is closed is adjustable to accommodate articles, such as clothing, of various thicknesses seated in the chamber 38 created between the jaws. This type of clamp construction is described in U.S. Pat. 3,767,092, issued Oct. 23, 1973 to Garrison et al.

The clamp disclosed in the Garrison et al. patent is modified in that a pair of inwardly extending straps 35, integral with the rear leg or jaw, are provided within the central chamber of the clamp (FIGS. 6 and 7). The rear jaw is open in the area behind the straps so that they may be molded with the rest of the clamp without the necessity for movable portions of the mold. The straps 35 form a vertically elongated passage 36 of a size to accommodate both the upper and the lower rails of one of the arms 13. Preferably the size of the passage and shape of the straps is such that substantial friction is generated between the straps and the rails and also between the rails and the inner face of the rear leg against which the rails are pressed by the straps 35. The straps hold the clamps permanently in alignment with the vertically spaced rails 16 and 17 so that when these rails are vertical, the clamps are also vertical. This is important to stabilize the position of the clamps when their spacing has been established.

To mount the clamps of the construction illustrated in FIGS. 6 and 7 on the rails 16 and 17 the clamp is simply pushed onto the rail over the ends 18 of the arms. Each of the clamps preferably has a pair of stops 37 of wedge shape which must be pushed past the end 18. This is possible because the clamps have a limited degree of resilience due to the nature of the plastic from which they are molded. However, the stops 37 are quite adequate to prevent the clamp from being inadvertently pulled off the ends of the arms, even though the clamps are moved quite forcibly along the rails 16 and 17.

Figure 2:
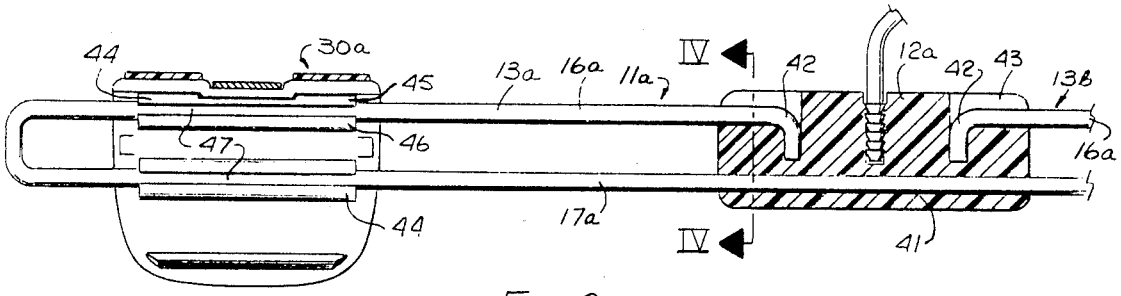
FIG. 2 is a fragmentary enlarged view of the center and one end portion of the hanger illustrated in FIG. 1.
Figure 4:
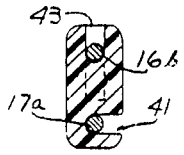
FIG. 4 is a sectional elevation view taken along the plane IV—IV of FIG. 2.

FIG. 2 illustrates a modified construction for the body 11. Thus, the body 11*a* has arms 13*a* and 13*b*, but formed from a single, continuous length of steel wire or rod. In this case, the lower rail 17*a* is continuous for the entire width of the hanger body and is seated in a slot 41 opening through one of the front or rear faces of the block 12*a* (FIGS. 2 and 4). The inner ends of the upper rails 16*a* extend into the block 12*a* and where their ends 42 are turned downwardly to seat in the appropriate sockets 43 in the block 12*a*. This arrangement provides positive support for the rails 13*a* and 13*b*, preventing their inner ends from spreading and, thus, preventing the arms on each side of the block bending downwardly under the weight of articles such as garments. This constructions permits the arms 13*a* and 13*b* to be assembled to the molded block 12*a* even though the rails on both sides of the block are formed from a single length of wire. This eliminates the necessity for having to accommodate the wire in the mold, a slow, labor intensive and generally unsatisfactory production procedure.

While clamps of the construction illustrated in FIGS. 6 and 7 can be used with this hanger body and the construction illustrated in FIGS. 1 and 2, it is also possible to use clamps of a different construction. Thus, as illustrated in FIG. 2, the clamp 30 has a pair of parallel rail gripping sockets 44, each consisting of a pair of fingers 45 and 46 separated by a slot 47, whereby the fingers 45 and 46 can be forced apart sufficiently to permit the rails to be inserted into the socket. The sockets 44 serve the same purpose as the straps 35 in supporting the clamps and in maintaining the clamps vertically aligned with the rails. The ability to do this results from the natural resilience of the polypropolyene plastic from which the clamps are molded.

Figure 8:
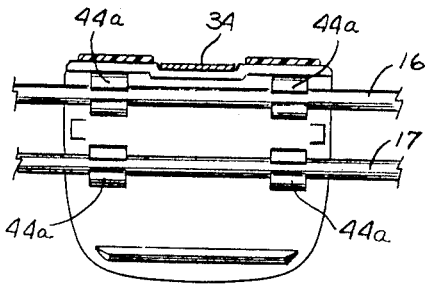
FIG. 8 is a sectional elevation view taken along the plane VIII—VIII of FIG. 5.
Figure 9:
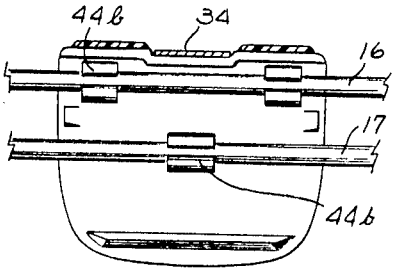
FIG. 9 is a sectional elevation view similar to FIG. 8 but illustrating a modified construction.

FIG. 8 illustrates a modification of the clamp wherein the clamp 30*b*, rather than having the elongated sockets, has a pair of spaced sockets 44*a* for each of the upper and lower rails. The function of the sockets 44*a* is the same as that of the sockets 44. This construction will use less material and produces less frictional grip on the rails 16 and 17. FIG. 9 illustrates an even further modification, in that only a single socket 44*b* is provided for gripping the lower rail 17. This is possible because, when a garment is gripped by the clamp, the rearward pressure exerted against the front jaw and the garment by the spring 34 will, to a large extent, be absorbed by the lower rail 17, thus reducing the pressure which would otherwise be exerted against the rear jaw of the clamp tending to release it from the lower rail.

Figure 10:
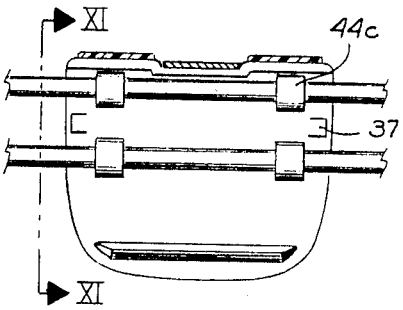
FIG. 10 is a sectional elevation view similar to FIG. 8, illustrating a still further modified construction of the invention.
Figure 11:
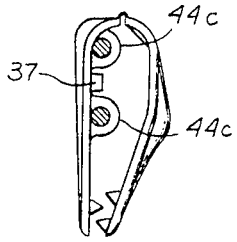
FIG. 11 is a sectional elevation view taken along the plane XI—XI of FIG. 10.

As illustrated in FIG. 11, the sockets 44*c*, whether of the long type, illustrated in FIG. 2, or of the short, individual type, illustrated in FIG. 10, do not have the front slot or opening and, thus, entirely surround the rails. This requires the rails to be of the construction illustrated in FIG. 12 whereby the U-shaped rail with a pair of ends which are secured to the central block 12, as illustrated in FIG. 12, must be used. The ends of these rails are passed through the sockets 44*c* before the rails are secured to the block 12 because the clamps cannot be mounted over the closed ends of the arms 13, once the arms have been secured to the central block.

It will be observed that in the case of all of the several clamp constructions illustrated, the plastic portion of the clamp body which engages the rails forms a firm, relatively high friction grip on the rails and, thus, when the clamps have been positioned, they will remain in that position under normal usage conditions, unless an operator intentionally applies enough lateral force to reposition the clamp. Polypropolyene is an appropriate material for this purpose because it has good frictional characteristics providing a firm grip with the rails. However, this friction is not enough to prevent lateral adjustment of the clamps. It will also be recognized that the spacing between the clamps can be adjusted to accommodate garments of various widths. One of the major uses of a hanger of this type is to transport and display skirts and slacks. In this case, there is a significant difference in the width of the garments which this invention permits a hanger of a single construction to be adjusted to accommodate. It is also of importance to this invention that the various plastic parts which make up the hanger can be individually molded and the hanger subsequently assembled. This has several advantages. It means that a mold cavity of a single design can be utilized for each component for all the hangers. Thus, a single cavity design can be utilized for the central block and for the clamps. This is because the clamps are all identical, there being neither left nor rights. Since the rails of the arms in both constructions can be mounted to the central block after molding of the block is complete it is unnecessary to make provision for accommodating the rails in the molds for either the central block or the clamps. This both simplifies the mold and it also appreciably reduces molding time. At the same time, a particularly strong and effective hanger results from the application of the principles of this invention, which hanger can be manufactured for a cost which is commensurate with the economics of the hanger market.

Since the clamps are separate items assembled to the hangers body after molding is complete, the hanger body, the rails and the clamps can each be made separately and each substantially modified without necessitating any changes in either of the other components. Thus, the design, size and gripping configuration of the clamps can be changed to satisfy various types of garments or other needs without requiring any change in the body of the hanger. IN a similar manner the length of the arms can be varied and the design and configuration of the central block can be changed, each without requiring any change in any of the other components of the hanger. These are important factors in both cost reduction and providing flexibility in application potential for the hanger.

Having described the preferred embodiment of the invention together with several modifications thereof, it will be recognized that other modifications of the invention can be made without departing from the principles of the invention. Such modifications are to be considered as included within the hereinafter appended claims, unless these claims by their language expressly state otherwise.

I claim:

1. An adjustable garment hanger having an elongated body of non-circular cross section-and means for suspending said body from a support, article clamps slidably mounted on and for movement along said body, each of said article clamps having support means on one leg thereof holding said clamp against pivotal movement about the longitudinal axis of said body and a second leg pivotally secured to said first leg at a point above said body and forming an article receiving chamber between said legs; means for holding said second leg in closed, article clamping position; said body extending through said chamber between said first and second legs; said support means forming socket elements projecting into said chamber, said socket elements embracing and, with sufficient friction to resist creep lengthwise of said body, engaging said body.

2. An adjustable garment hanger having an elongated body and means for suspending said body from a support, said body including oppositely extending arms having upper and lower portions, said portions being vertically spaced a distance substantially greater than the front to back thickness thereof, a pair of article clamps slidably mounted on and for independent movement along the arms of said body, said article clamps each having front and back jaws pivotally joined at a point spaced from and above said body and forming an article receiving and clamping chamber between them; said body extending laterally through, said chamber, support means integral with said back jaw of each clamp and projecting into said chamber and slidably embracing the arms of said body and supporting said clamps against pivotal movement about the longitudinal axis of said body, and providing frictional engagement with said arms sufficient to resist creep of said clamps longitudinally of said body under normal use of the hanger.

3. The adjustable garment clamp described in claim 2 wherein said body includes a pair of oppositely extending arms each having a pair of spaced rods arranged in a vertical plane.

4. A garment hanger as described in claim 3 wherein said support means includes separate elements for engaging each of said upper and lower rods.

5. A garment hanger as described in claim 4 wherein a pair of said elements are provided for engaging each of said upper and lower rods.

6. A garment hanger as described in claim 3 wherein said rods form U-shaped loops extending in opposite directions with the closed portions of the U forming the outer ends of said body.

7. The adjustable garment clamp described in claim 3 wherein said support means is a plurality of discrete gripping elements each forming a socket for receiving and embracing one of said rods, at least two of said gripping elements engaging one of said rods.

8. The adjustable garment clamp described in claim 7 wherein each of said gripping elements has a slot like opening in the inner face thereof through which said rods may be forcibly caused to pass to enter the sockets as the clamp is mounted on said body.

9. The adjustable garment clamp described in claim 2 wherein said arms are integrally joined by a vertical portion at the ends thereof.

10. The adjustable garment clamp described in claim 7 wherein said body includes a central block, said suspension means being secured to said block; said arms being supported on and secured to said block.

11. The adjustable garment clamp described in claim 2 wherein said support means is a pair of spaced straps each forming a vertically elongated passage for receiving said body therethrough.

12. The adjustable garment clamp described in claim 2 wherein said support means each are sockets having a laterally extending central passage of a size to snugly grip said body.

13. The adjustable garment clamp described in claim 2 wherein said body includes a pair of oppositely extending arms each formed of a pair of spaced rods each having a major dimension arranged in a vertical plane; said support means being sockets each having a laterally extending central passage of a size to snugly grip said body.

14. The adjustable garment clamp described in claim 13 wherein the front face of said support means is slit to divide the walls of said sockets into two opposed fingers and provide an opening through which said rods may be forcibly caused to pass and enter the passage within said sockets.

15. A garment hanger having an elongated body and means centered between the ends thereof for suspending said body, the ends of said body on each side of said means having upper and lower portions, said portions being vertically spaced a distance substantially greater than the front to back thickness thereof; a pair of clamps, one on each side of said means for suspending a garment therebetween each of said clamps having vertically extending front and back jaws forming an article receiving chamber therebetween, said jaws being integral and hingedly joined at their upper ends; said ends of said body passing through the chamber of each of said clamps; anchor means integral with the rear jaw of each of said clamps extending into said chamber and embracing and frictionally engaging both the upper and lower portions of said ends of said body to restrict said clamps against both sliding movement therealong under normal garment supporting conditions and rotation about the central axis of said body.

16. A garment hanger as described in claim 15 wherein each of the ends of said body on each side of said means is formed of a pair of vertically spaced rigid rods arranged in a vertical plane; said anchor means each have convergent fingers separated by a slot to form sockets into which said rods may be forcibly inserted whereby said clamps are detachably supported on said rods.

* * * * *